United States Patent [19]

Hunter

[11] Patent Number: 4,695,028

[45] Date of Patent: Sep. 22, 1987

[54] DEVICE FOR HOLDING CONSTRUCTION MATERIALS

[76] Inventor: Wayne W. Hunter, 2823 Sherman Ave., NW., Apt. #2, Washington, D.C. 20036

[21] Appl. No.: 851,634

[22] Filed: Apr. 14, 1986

[51] Int. Cl.[4] ..... E04G 25/00

[52] U.S. Cl. ..... 248/354.1; 414/11

[58] Field of Search ..... 248/354.1, 622, 623, 248/600, 601, 407, 408, 409, 162.1; 269/289 R; 414/11

[56] References Cited

U.S. PATENT DOCUMENTS

| | | | |
|---|---|---|---|
| 130,922 | 8/1872 | Lathrop et al. | 248/600 |
| 636,726 | 11/1899 | Hindmarsh | 248/601 X |
| 1,209,561 | 12/1916 | Crease | 248/601 |
| 2,048,148 | 7/1936 | Stoll | 248/600 X |
| 2,964,293 | 12/1960 | Foth | 414/11 X |
| 2,966,993 | 1/1961 | Cooper | 414/11 |
| 2,969,220 | 1/1961 | Spencer | 414/11 X |
| 3,167,289 | 1/1965 | Nasjleti | 248/600 X |
| 3,208,555 | 9/1965 | Fry | 414/11 X |
| 3,365,080 | 1/1968 | Crull | 414/11 |
| 3,910,421 | 10/1975 | Panneton | 414/11 |
| 3,930,645 | 1/1976 | Anderson | 269/289 R |
| 4,111,408 | 9/1978 | Love | 269/289 R |
| 4,120,484 | 10/1978 | Zimmer | 414/11 X |
| 4,375,934 | 3/1983 | Elliott | 414/11 |
| 4,576,354 | 3/1986 | Blessing | 248/351 X |

*Primary Examiner*—J. Franklin Foss

*Attorney, Agent, or Firm*—Pollock, Vande Sande & Priddy

[57] ABSTRACT

A device for holding an object in an elevated position comprising an outer tube and shaft member slidably disposed within the outer tube. A support member is mounted at one end of the shaft. The shaft slides within the outer tube between lower and upper positions. A spring is disposed within the outer tube and is connected between the outer tube and shaft member which upwardly urges the shaft to the upper position for holding an object. A trigger is provided for releasably retaining the shaft while in its lowered position.

7 Claims, 7 Drawing Figures

FIG. 4A
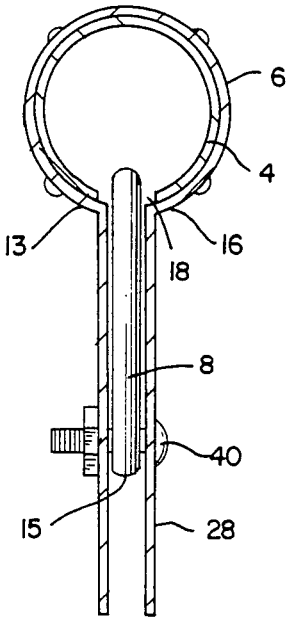
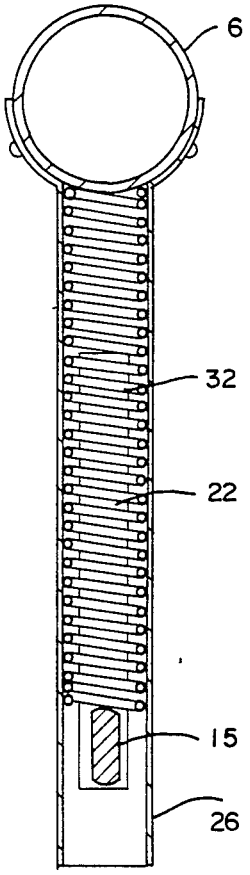
FIG. 4B

DEVICE FOR HOLDING CONSTRUCTION MATERIALS

BACKGROUND OF THE INVENTION

The present invention relates to a device for holding an object in an elevated position. This device can be particularly useful in the construction industry for holding wallboard for example Sheet-Rock in a firm, elevated position while it is being secured to a ceiling or wall.

There is a known machine for lifting and holding construction material sheets. However, in this machine an operator manually rotates a wheel which through an associated linkage moves a holding means upwardly to the ceiling for holding the construction material in position while it is being secured to the ceiling. Such a machine for lifting and holding is inconvenient in operation because of its weight, large dimensions and low speed of lifting.

It is thus an object of the present invention to provide a device of simple construction which operates quickly and can be easily moveable from one location to another on the construction site. In accordance with the invention, this is accomplished by providing a device which utilizes a spring means to rapidly propel a supporting member towards the ceiling for holding a sheet of construction material.

SUMMARY OF THE INVENTION

The device according to a preferred embodiment of the present invention contains an outer tube and a shaft. The shaft is slidably disposed within the outer tube between an upper and lower position. A support member is mounted at the top end of the shaft member for holding the object in an elevated position. Spring means are disposed within the outer tube and are associated with the shaft member. The spring means upwardly urge the shaft member to assume the upper position. Means are also provided for releasably retaining the shaft member in a lower position. To this end at least one aperture or recess is provided on the shaft member at its top end. The outer tube is provided with a similar aperture or opening. When the shaft is being pulled downwardly to assume its lower position the two corresponding apertures will align with each other. One end of a trigger handle which is pivotally mounted on the outer tube is adapted to enter the aligned openings to prevent further movement of the shaft member within the outer tube.

In this retained position the spring associated with the shaft is stretched out from its relaxed state and remains in such position until the retaining means are released. Release of the retaining means triggers the spring action. The spring returns back to its relaxed position while at the same time upwardly urging the associated shaft member with the support member at its end against the object and holds the object in an elvated position.

After the construction sheet is secured to the ceiling the shaft is pulled down and retained in its lower position. The device can then be easily moved to another location. Upon release of the retaining means the shaft of the device quickly returns to its upper position by the spring action and holds the next piece of Sheet-Rock for application to either ceiling or wall.

The use of a device of the present invention in the construction field has numerous advantages. Construction materials such as plywood or wallboard for example Sheet-Rock may be held very firmly in an elevated position by the device whereby the construction worker is not required to manually support such heavy sheets of construction materials while at the same time securing them for example to the ceiling. Simple, fast operation of the device shortens installation time, substantially reduces the physical effort required from installation personnel and results in a more economical and therefore more cost competitive installation. For example, by use of the invention it may be possible for a single worker to install large sheets of construction materials whereas in the absence of a holding device at least two workers would be necessary.

While the device will be described in further detail with reference to its employment in supporting wallboard to a ceiling it is not limited to such use and additional applications can be envisioned by those skilled in the art.

BRIEF DESCRIPTION OF THE DRAWINGS

The device according to the invention will now be described in detail with reference to the accompanying drawings in which

FIGS. 4*a* is a cross-section view taken along lines B—B' of FIG. 1 showing in more detail the operation of the trigger handle.

FIG. 4*b* is a cross-section view taken along lines C—C' of FIG. 2 showing in more detail the trigger spring.

PREFERRED EMBODIMENTS OF THE PRESENT INVENTION

Figure 1:
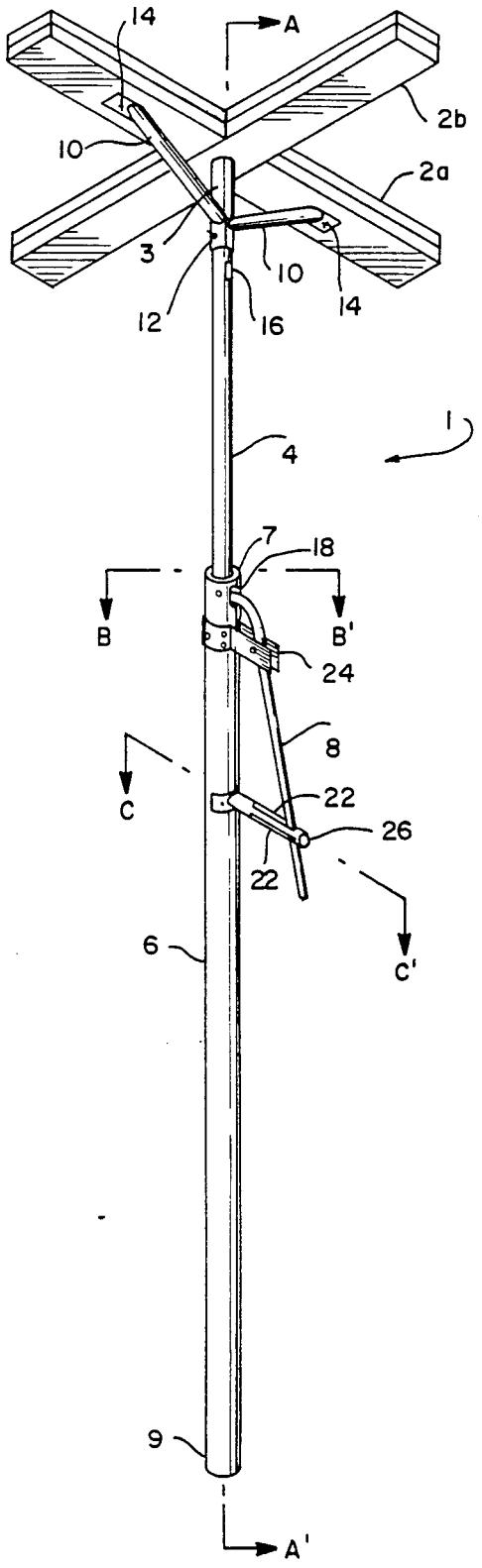
FIG. 1 shows a perspective view of the device for holding an object in an elevated position.
Figure 2:
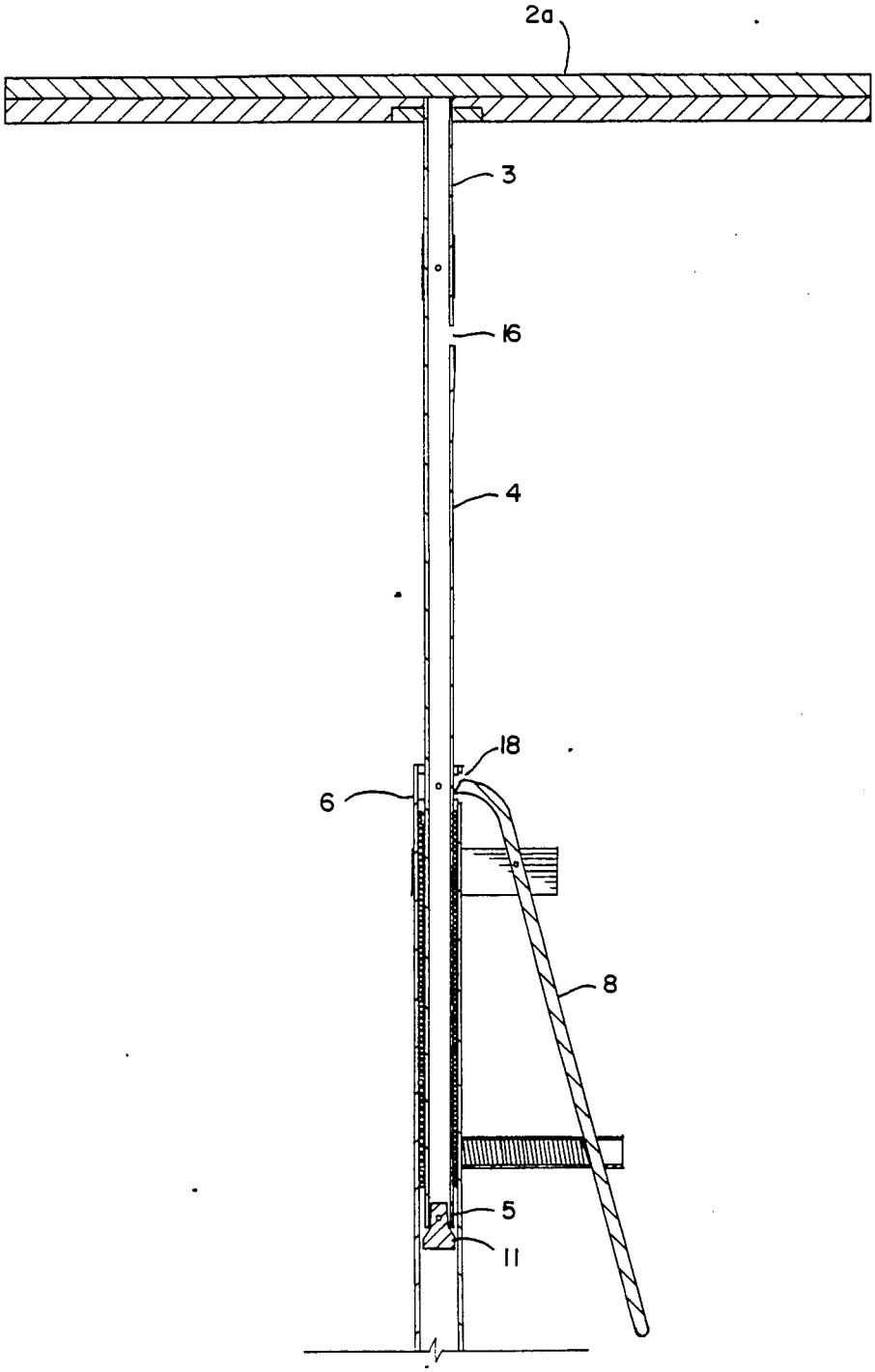
FIG. 2 shows a cross-section of the holding device taken along lines A—A' of FIG. 1.
Figure 3:
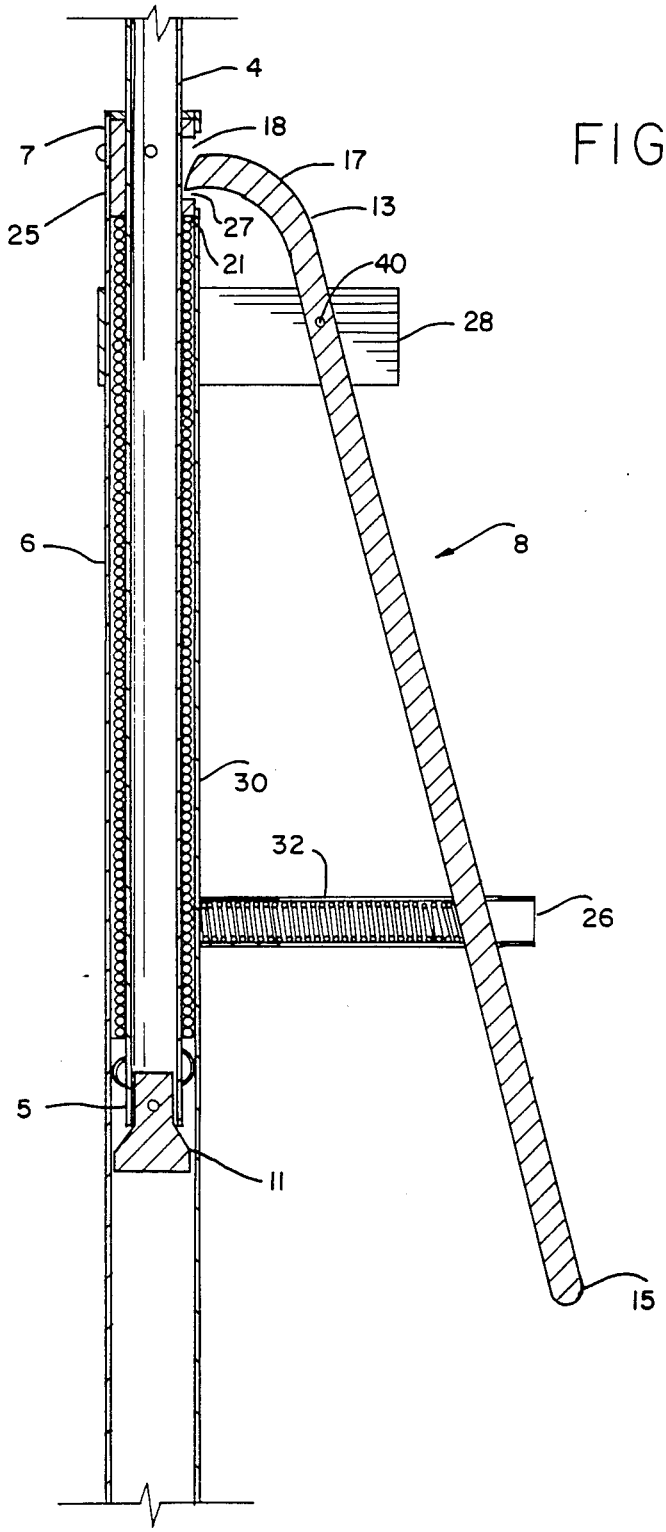
FIG. 3 is a cross-section view taken along the same lines A—A' of FIG. 1 showing in more detail the spring and retaining means.

Referring now to FIGS. 1 and 2, 3, device 1 is shown having a shaft 4 preferably in the form of an inner tube and an outer tube 6 having an upper end 7 and a lower end 9. Shaft 4 has a top end 3 and a bottom end 5. Shaft 4 is disposed within outer tube 6 and is slidable within the outer tube 6 between an upper position and a lower position. A support member 2 is provided at the top end of shaft 4 for holding the Sheet-Rock or other similar material in an elevated position against the ceiling.

In the preferred embodiment of the present invention the support member 2 consists of two perpendicular cross-bars 2*a*,2*b*. Two arms 10 are secured to the shaft 4 at one of their ends by fastening means 12, and the opposite ends of arms 10 are fixed to the cross-bar 2*a* by fastening means 14. The arms 10 facilitate manual pulling of the shaft 4 downwardly within the outer tube 6. Shaft 4 is provided with at least one aperture or recess 16 located at its top end 3 below the support member 2. Outer tube 6 is provided with a corresponding opening or recess 18 at its upper end 7. As shown in FIGS. 2 and 3 a spring 30, preferably in the form of a closed coiled spiral, is disposed within the outer tube 6. One end 21 of spring 30 is fastened to the structure of outer tube 6 which is provided with collar member 25 at its upper end 7. Spring 30 surrounds shaft 4 which is disposed within the tube and is secured by any conventional means such as welding or bolting to the bottom end 5 of shaft 4 at opposite end 23 of the spring 30. A wooden member 11 is also provided at bottom end 5 of the shaft for preventing withdrawal of the shaft 4 from the outer tube 6 during upward movement of the shaft 4 within the outer tube 6.

The device is further provided with a trigger handle 8 having a first end 15 and a second end 13. The second end 13 of the trigger handle is bent and terminates into a tapered-nose portion 17 forming a tip 27. The trigger handle 8 is pivotally mounted at its second end 13 on the outer tube around the pivot 40 supported by bracket 28. First end 15 of the trigger handle is slidably disposed within bar 26. To this end bar 26 is provided with at least two longitudinal slots 22 through which the first end 15 of the trigger handle 8 enters the bar 26 and can be moved towards the outer tube. Bar 26 is mounted on the outer tube substantially parallel and spaced away from the bracket 28.

A second trigger spring 32 is disposed within the bar 26 between the outer wall of outer tube 6 and the trigger handle 8. Second spring 32 is of an open coil spiral type and in its relaxed state urges the second end 15 of the trigger handle 8 outwardly from the outer tube 6 whereby the first end 13 of the trigger handle enters aperture or recess 18 in the outer tube 6 and rests upon the outer wall of the shaft member 4 with its tip 27 pressing the surface of the wall.

Operation of the device according to the present invention will now be described in detail. The shaft member 4 is pulled downwardly from its upper position by application of manual force upon the arms 10 and slides within outer tube 6. Spring 30 extends from its relaxed position in the direction of the bottom end of the shaft sliding within the outer tube 6. Movement of the shaft member 4 and stretching out of the spring connected to the end of the shaft continues until the aperture 16 on the shaft member 4 aligns with recess 18 on the outer tube 6. The tip 27 of the second end 13 of the trigger handle pressing upon the wall of the shaft 4 now enters the aligned apertures 16,18 in outer tube 6 and shaft 4 as shown in FIG. 4*a*. At the same time the first end 15 of the trigger handle assumes the most distant position within slots 22 of bar 48 and second spring 32 springs to its relaxed position, as shown in FIG. 4*b*. The shaft member 4 together with support member 2 is now in its lower position and is retained in this position by means of trigger handle 8.

The device can in the lowered position be moved to a desired location underneath the wallboard that is to be held. By pressing the second spring 32 with the second end 15 of the trigger handle 8, the first end 13 of the trigger handle 8 pivotally mounted on the outer tube 6 is withdrawn from the aligned apertures 16, 18. Withdrawal of the retaining means triggers the spring action of the spring 30. The spring 30 returns to its relaxed position and at the same time upwardly urges the shaft member 4 to its upper position. Spring 32 causes the tip 27 of trigger member 8 to press against the surface wall of shaft 4 holding it in a firm position. Support member 2 mounted at the end of shaft 4 now presses against the wallboard and holds it in the elevated position. After the wallboard or other construction materials have been secured to the ceiling, the operation of pulling the shaft member 4 to a lowered position and retaining it in this position by use of trigger handle 8 can be repeated to facilitate relocation of the device for holding the next sheet of material to be installed.

The device can be also provided with a stand (not shown) which allows mounting of lower end 9 of the outer tube. In such an implementation with the device extended to the upper position to hold a sheet of construction material the worker is freed to secure the material to the ceiling.

In an actual embodiment of the invention in which the invention is used for installation of wallboard to a ceiling at a standard construction height, the length of the outer tube is approximately 6 feet. The length of the inner tube is approximately 4 feet and the height of the device with the shaft in the upper position is approximately 9½ feet. However the functional height of the device can be adjusted by placing the outer tube on a stand of desired dimensions or by providing additional apertures in the shaft 4 spaced apart in the direction of the length of the shaft.

Figure 5B:
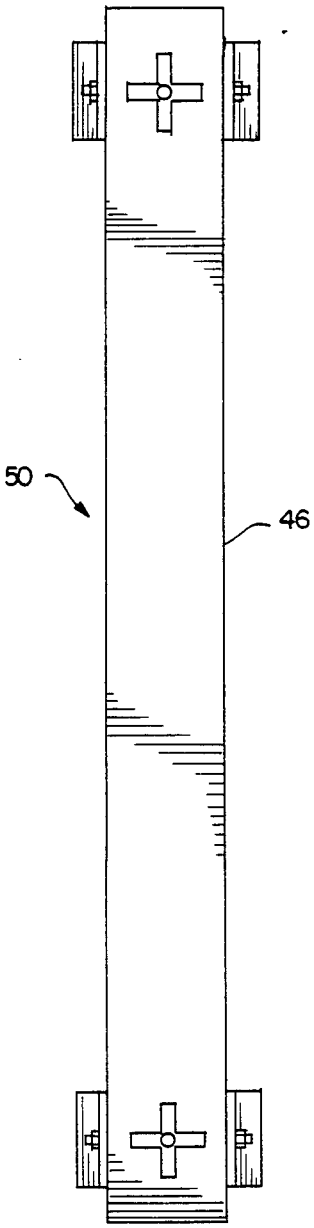
FIG. 5B shows a top view of the bench of FIG. 5A.
Figure 5A:
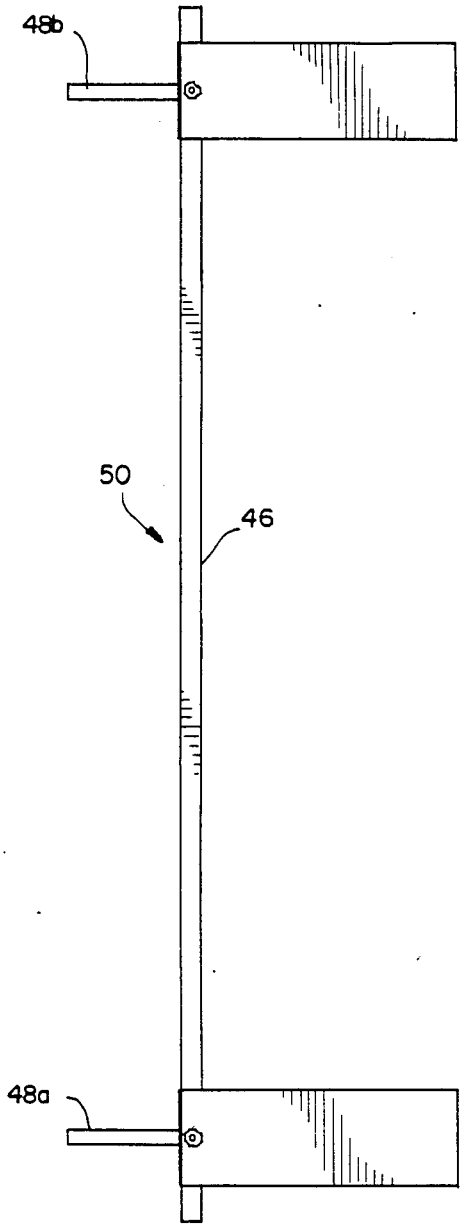
FIG. 5A shows a side of view of a bench for mounting two of the devices according to the invention.

In another embodiment of the invention which is shown in FIG. 5, the assembly 50 for holding an object in an elevated position is comprised of two identical devices 48*a* and 48*b* of the structure described above, which are mounted at opposite ends of a workbench 46 for supporting the wallboard at its opposite ends.

I claim:

1. A device for holding a sheet of construction material in an elevated position so that the sheet may be secured to a ceiling comprising:

a first rigid member, a second member which is elongated and which is spaced from said first member and adapted to assume an upper and lower position with respect to said first member, said second member having a support means at one end for holding said sheet, spring means attached at opposite ends to said first and second members respectively for upwardly urging said second member to said upper position;

retaining means for releasably retaining said second member in said lower position, and activable release means for upon activation releasing said retaining means and causing said spring means to quickly propel said second member from said lower to said upper position.

2. A device according to claim 1 wherein said first rigid member is also elongated.

3. A device according to claim 2 wherein said first member is an elongated tube member and wherein said second member is slidably disposed within said tube member.

4. A device according to claim 1 wherein said retaining means includes at least one aperture in said second member aligned with a corresponding aperture in said first member when said second member occupies said lower position.

5. A device according to claim 4 wherein said retaining means further includes part of a bar member having first and second ends, said bar member being pivotally connected to said first member, said first end of said bar being adapted for insertion into said aligned apertures.

6. A device according to claim 5 wherein said activatible release means comprises a second spring mounted between said first member and said second end of said bar member for urging the entrance of said first end of said bar member into said aligned apertures.

7. A device according to claim 6 wherein said first member is adapted for mounting on a stand.

* * * * *